United States Patent [19]

Hart

[11] Patent Number: 4,895,179

[45] Date of Patent: Jan. 23, 1990

[54] CLEANING APPARATUS

[75] Inventor: Bernard E. Hart, Rosebank, England

[73] Assignee: Harben Systems Limited, Salisbury, England

[21] Appl. No.: 191,249

[22] Filed: May 6, 1988

[30] Foreign Application Priority Data

May 13, 1987 [GB] United Kingdom ..... 8711306

[51] Int. Cl.[4] ..... B08B 3/02

[52] U.S. Cl. ..... 134/172; 134/177; 134/179; 134/180

[58] Field of Search ..... 15/98, 320; 134/172, 134/177, 179, 176, 180; 239/754, 251, 265.11, 265.25

[56] References Cited

U.S. PATENT DOCUMENTS

| | | | |
|---|---|---|---|
| 2,104,062 | 1/1938 | Temple | 15/98 X |
| 3,922,991 | 12/1975 | Woods | 134/172 X |
| 4,005,723 | 2/1977 | Rosenberg | 134/180 X |
| 4,112,535 | 9/1978 | Wild et al. | 134/172 X |
| 4,191,589 | 3/1980 | Halls et al. | 134/176 |
| 4,375,451 | 3/1983 | Seligman et al. | 134/172 X |

FOREIGN PATENT DOCUMENTS

| | | | |
|---|---|---|---|
| 1233759 | 10/1960 | France | 134/179 |
| 554029 | 1/1957 | Italy | 134/179 |
| 465164 | 12/1968 | Switzerland | 134/179 |
| 724230 | 3/1980 | U.S.S.R. | 134/179 |

*Primary Examiner*—Frankie L. Stinson

*Attorney, Agent, or Firm*—Scrivener and Clarke

[57] ABSTRACT

Cleaning apparatus for cleaning a generally planar generally horizontal surface comprises at least one nozzle for providing a jet of cleaning liquid directed against the surface and which is mounted by an arm on a shaft for rotation about the axis of the shaft which is perpendicular to the surface. The nozzle rotates within a chamber defined by a casing assembly which has an open lower end closed by the surface to the cleaning and which carries a seal for sealing against the surface to contain cleaning liquid within the chamber. The casing assembly defines a peripheral liquid collection region from which the liquid is withdrawn through an outlet by a pump. The nozzle is self-motivating and may be associated with an impellor having blades for inducing flow of ambient fluid, e.g. air, into the chamber, the air flowing out of the chamber with the cleaning liquid and assisting removal of cleaning liquid therefrom.

16 Claims, 8 Drawing Sheets

CLEANING APPARATUS

The present invention relates to cleaning apparatus for cleaning generally planar generally horizontal surfaces and which uses at least one rotating jet of relatively high pressure liquid.

It has been proposed to clean generally planar surfaces using high pressure liquid, the apparatus comprising a rotating nozzle assembly which provides a plurality of high pressure jets of liquid which are directed onto the surface to be cleaned. By suitably angling the nozzles relative to their axis of rotation, the nozzle assembly can be self-motivating, i.e. the nozzle assembly is rotated by the reaction forces of the liquid issuing from the nozzles. A disadvantage of this apparatus is that it leaves the cleaning liquid, and detritus, on the clean surface.

According to one aspect of the present invention there is provided cleaning apparatus for producing a jet of cleaning liquid which is directed against a surface to be cleaned and which rotates about an axis generally perpendicular to the surface to be cleaned, the apparatus comprising nozzle means, means for connecting the nozzle means to a supply of pressurized liquid, means mounting the nozzle means for rotation about the axis, the nozzle means being adapted to provide a jet of cleaning liquid and to cause rotation of the nozzle means about the axis, casing means for defining with the surface to be cleaned a chamber generally coaxial with the axis and surrounding the nozzle means, the casing having an open end to be applied against the surface to be cleaned and which is provided with sealing means for sealing against the surface, and outlet means for liquid in the region of the open end of the casing for removing cleaning liquid from the chamber.

The above described apparatus may include impeller means mounted for rotation by and with the nozzle means for inducing a flow of ambient fluid, e.g. air, into the chamber and then out of the chamber through the outlet means to assist flow of liquid from the chamber through the outlet means.

According to another aspect of the present invention there is provided cleaning apparatus for producing a jet of cleaning liquid which is directed against a surface to be cleaned and which rotates about an axis generally perpendicular to the surface to be cleaned, the apparatus comprising nozzle means, means for connecting the nozzle means to a supply of pressurized liquid, means mounting the nozzle means for rotation about the axis, the nozzle means being adapted to provide a jet of cleaning liquid and to cause rotation of the nozzle means about the axis, impeller means mounted for rotation with the nozzle means, casing means for defining with the surface to be cleaned a chamber generally coaxial with the axis and surrounding the nozzle means and impeller means, the casing means having an open end to be applied against the surface to be cleaned and which is provided with sealing means for sealing against the surface to be cleaned, inlet means for ambient fluid for permitting ambient fluid to enter the chamber in the region of the axis and outlet means for liquid and fluid in the region of the open end of the casing means for removing cleaning liquid and fluid from the casing means, the arrangement being such that, in use, rotation of the impeller means with the nozzle means about the axis draws ambient fluid into the chamber through the inlet means, flow of ambient fluid from the chamber through the outlet means assisting flow of liquid from the chamber through the outlet means.

The apparatus may comprise a plurality of nozzle means to provide a plurality of jets of cleaning liquid angularly spaced apart about the axis and the or each nozzle means may comprise a first nozzle for providing a jet of liquid directed against the surface to be cleaned and an auxiliary nozzle associated with the first nozzle for providing a jet having a substantial component tangential to the path of rotation of the first nozzle to cause rotation of the first nozzle about the axis. The first nozzle may be arranged to provide a jet having an axis inclined to the axis of rotation of the nozzle means in a direction so that the jet is directed away from the axis of rotation of the nozzle means. Alternatively, the or each nozzle means may be adapted to provide a jet of liquid directed against the surface to be cleaned and whose axis is inclined to the axis of rotation of the nozzle means in a direction so that the jet is directed away from the axis and has a component tangential to the path of rotation of the nozzle means to cause rotation on the nozzle means.

The casing means preferably defines at least in part a liquid collection region in which cleaning liquid collects and into which the outlet means opens. The liquid collection region advantageously extends circumferentially of the casing adjacent the sealing means and may in part be defined by a flange extending radially outwardly around the open end of the casing means and on which the sealing means is mounted. The liquid collection region may have an extent radially of the axis which varies in the circumferential direction, the or each outlet means opening into the widest or each wider zone of the liquid collection region.

Pump means may be provided for withdrawing liquid from the chamber through the outlet means and the pump means is advantageously adapted and connected to be powered by liquid from the liquid supply for the nozzle means Embodiments according to the present invention will now be described, by way of example only, with reference to the accompanying drawings.

Figure 1:
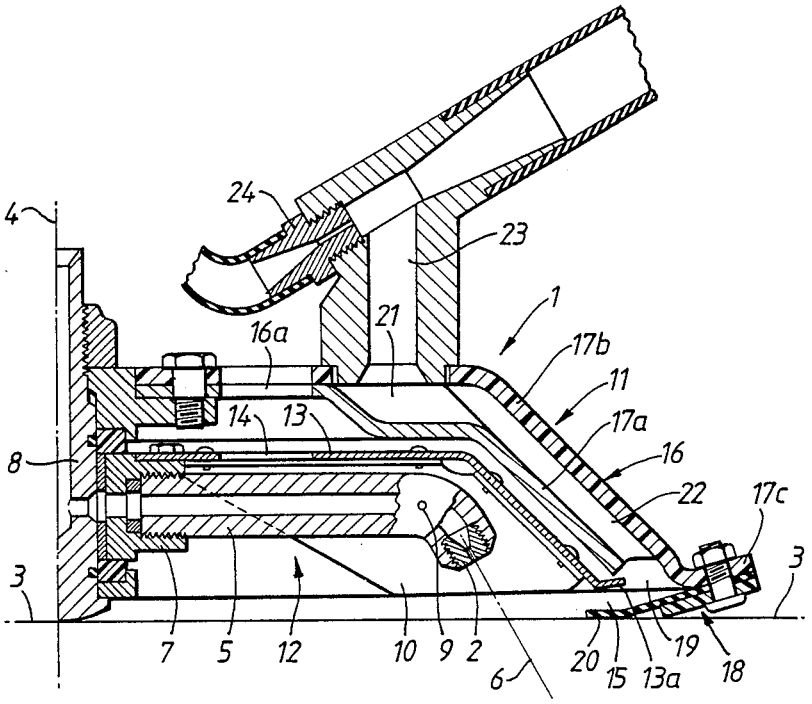
FIG. 1 is an axial section through an embodiment of apparatus according to the present invention.
Figure 2:
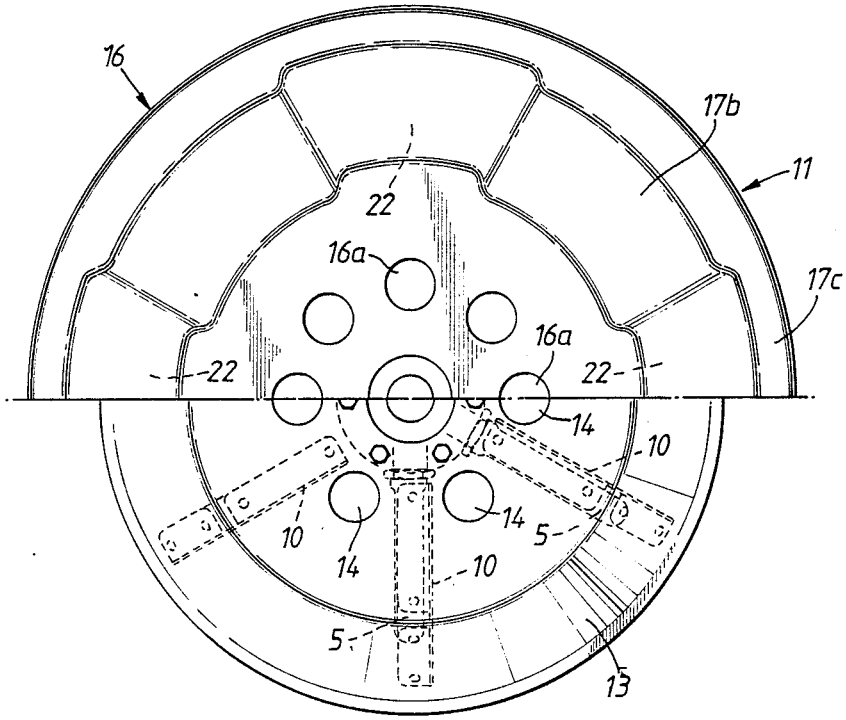
FIG. 2 is a top plan view of the apparatus of FIG. 1 with parts cut away.

The cleaning apparatus shown in FIGS. 1 and 2 comprises at least one nozzle means comprising a nozzle 2 which is connected to a supply of relatively high pressure liquid and provides a jet of that liquid which is directed against a surface 3 to be cleaned thereby. The nozzle 2 is mounted for rotation about an axis 4 defined by the apparatus and which is generally perpendicular to the surface 3 to be cleaned. As shown in FIGS. 1 and 2, the apparatus comprises a plurality of, for example as shown two, nozzles 2 which are equiangularly spaced around the axis 4. Each nozzle 2 is mounted at the end of a tubular radially extending arm 5 through which liquid is supplied to the nozzle 2, the nozzle being threaded into the open end of the arm 5 which is adapted, for example as shown, to provide the axis 6 of the nozzle 2 with the required orientation. The inner ends of the arms 5 are fixed in a hub 7 which is rotatably mounted on a shaft 8 defining axis 4 and through which liquid is supplied to the arms 5. Hub 7 is mounted on shaft 8 with suitable rotary bearings which are preferably self-lubricating.

The axis 6 of each nozzle 2 is advantageously inclined to the axis 4 so that the jet issuing from the nozzle is directed away from the axis 4. Thus, with the arms 5 rotating, liquid issuing from nozzles 2 will flow along a generally spiral path away from axis 4 and this spiral motion will be increased by the centrifugal force provided by rotation of the nozzles. The assembly of arms 5 with their nozzles is arranged to be self-motivating and to be rotated by the high pressure liquid. This may be achieved by inclining the axes 6 of nozzles 2 to the path of movement of the nozzles 2 so that each jet has a tangential component, the reaction of which will cause the arms 5 to rotate. Alternatively, each nozzle means may comprise an auxiliary nozzle 9 mounted in the respective arm 5 adjacent the respective nozzle 2 and which provides a jet of the cleaning liquid having a tangential component, the reaction to which causes rotation of the respective arm 5. The axis of the jet from each auxiliary nozzle 9 may be inclined towards surface 3 by for example 20° so that the jets do not impinge on other parts of the apparatus.

The arms 5 and nozzles 2 are arranged for rotation within a casing assembly 11 which, together with the surface 3 to be cleaned, defines a chamber 12. The casing assembly 11 is generally circular in section, coaxial with the axis of rotation of the nozzles and has an open lower end which is applied to the surface to be cleaned and which is provided with sealing means 18 for sealing against the surface 3 to contain the cleaning liquid issuing from nozzles 2 and 9 (where provided). Outlet means through which liquid in the chamber is removed are provided in the region of the sealing means as will be described hereafter.

In this embodiment, a centrifugal impeller is associated with the nozzles 2 for rotation therewith and thereby and the casing assembly 11 is provided with inlet means for ambient fluid adjacent axis 4 and through which ambient fluid, e.g. air, is drawn into chamber 12 by the impeller blades 10.

In this embodiment, the casing assembly 11 comprises an inner casing 13 which has inlet openings 14 adjacent axis 4 and whose open lower end is spaced from surface 3 and provides therebetween outlet opening means defined by an annular opening 15 for fluid, and an outer casing 16. Inner casing 13 is arranged to rotate with blades 10 and arms 5 and indeed blades 10 are mounted on the casing 13 which is fixed, e.g. bolted, to hub 7 so that the casing 13 with the blades 10 are rotated by the arms 5 through the hub 7.

Outer casing 16 is stationary, is mounted on and fixed to shaft 8 and has axial inlet opening **16*a* generally radially aligned with inlet openings 14 in casing 13, for flow of ambient fluid into the casing assembly, and comprises an inner wall 17*a* which generally follows the contours of inner casing 13, and outer wall 17*b*. Inner wall 17*a* terminates adjacent the open end of casing 13 which is provided at its open end with an outturned lip 13*a* for closing the gap between the open lower ends of wall 17*a* and casing 13 to prevent ambient fluid in casing 13 flowing out through outlet 15 and then through the space between wall 17*a* and casing 13 and back to the inlet openings 14**.

The outer wall **17*b* of casing 16 is provided at its lower edge with an outwardly directed annular flange 17*c* on which is mounted the sealing means 18 for sealing against surface 3 and which, together with the casing assembly provides an annular region 19 for collection of liquid from chamber 12. In this embodiment, the liquid collection region 19 has an outer side including the sealing means 18, which extends continuously around the open end of the casing assembly and comprises a flexible annular sealing strip 20, e.g. of Neoprene, which bears against surface 3 and is inclined inwardly towards axis 4 to form an extension of surface 3 along which liquid on surface 3 will flow to region 19 and which defines with the outturned lip 13*a* at the open end of casing 13, the annular outlet 15 which, in turn, defines the inner side of the liquid collection region to connect the chamber 12 freely with the liquid collection region 19**.

Figure 3:
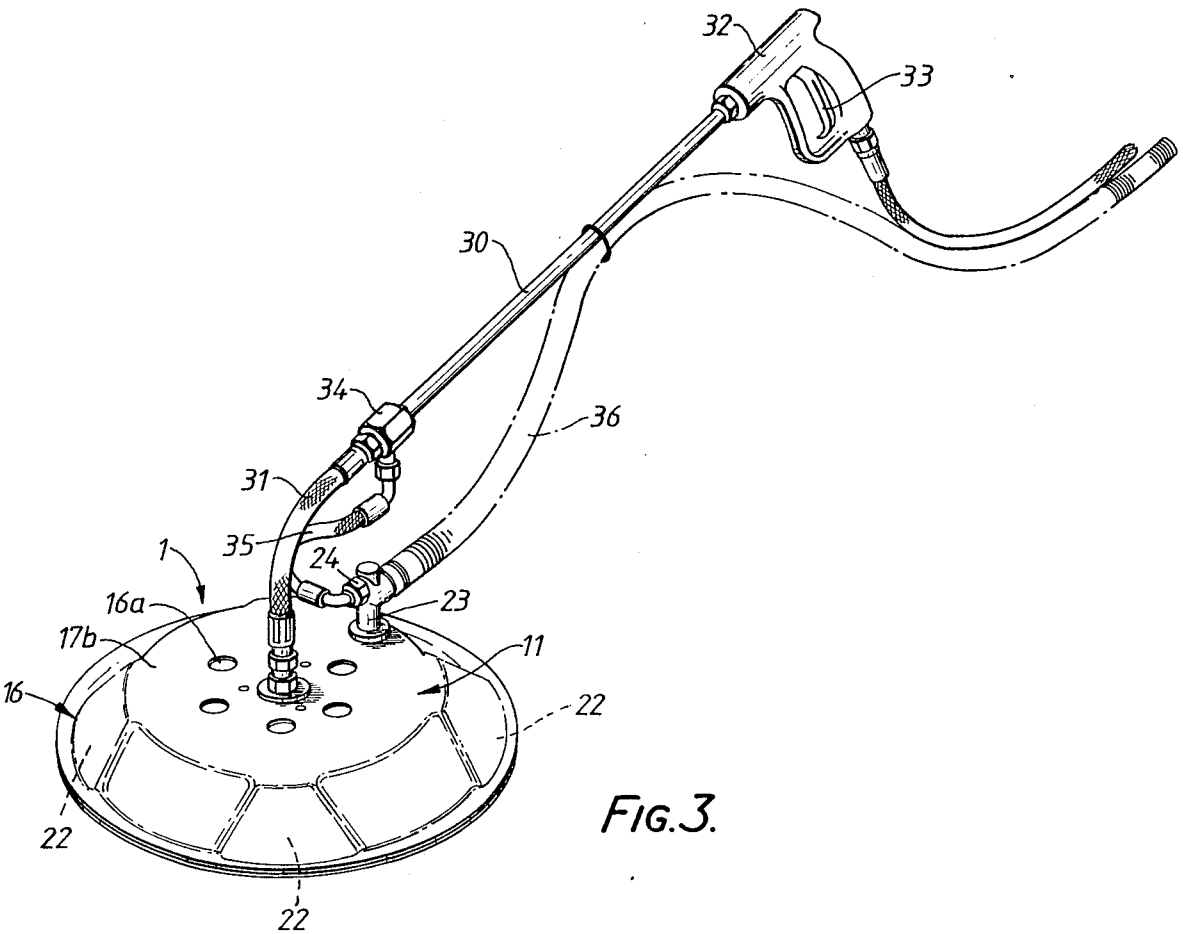
FIG. 3 is a perspective view of the apparatus shown in FIGS. 1 and 2.

Liquid collection region 19 extends continuously around the periphery of the casing assembly 11 and communicates with an annular collection chamber 21, defined between walls **17*a* and 7*b*, by a plurality of outlet channels 22 extending up the walls, the channels 22 being spaced apart around axis 4, defined between walls 17*a* and 17*b* and opening at one end into region 19 and the other end into chamber 21. For defining channels 22, wall 17*b* has a stepped peripheral configuration and is at intervals spaced from wall 17*a* to define the channels 22. Between channels 22, wall 17*b* lies against wall 17*a*. Liquid and fluid in annular channel 21 is withdrawn therefrom through an outlet 23 and withdrawal of liquid and fluid from the apparatus is effected or assisted by a pump connected to outlet 23. Preferably the pump is driven by high pressure liquid and specifically liquid taken from the supply to the nozzles. As shown in FIG. 3, the pump comprises a venturi device 24** to which the high pressure liquid is supplied and which provides the pumping action.

In use of the above described apparatus, high pressure liquid is supplied to shaft 8 and flows from shaft 8 to arms 5 and nozzles 2 and 9 (where provided) to provide jets of liquid for cleaning surface 3 and to cause rotation of the nozzles 2 around axis 4. As previously described, liquid from nozzles 2 after contacting surface 3 will flow across surface 3 along a generally spiral path away from axis 4 by virtue of the inclination of the axes of nozzles 2 and the centrifugal force on the liquid issuing from the nozzles by virtue of their rotation, towards the sealing means 18 and liquid collection region 19. Rotation of the nozzles 2 and arms 5 also causes rotation of blades 10 of the impeller means. Rotation of the blades 10 causes ambient fluid, which will ordinarily be air, to be drawn into chamber 12 through inlet opening **16*a* and 14 and the air will then flow from chamber 12 together with the cleaning liquid. This flow of air assists flow of liquid through the outlet 15 into the collection region 19 from which the liquid and air is withdrawn through channels 22, chamber 21 and outlet 23**.

The lower edges of the blades 10 are arranged so that they will lie above the anticipated level of liquid flowing across surface 3 so that the blades themselves do not interfere with the flow of liquid. Additionally, lip 13*a* defining the upper extent of opening 15 is arranged so that it too lies above the anticipated level of liquid flowing across surface 3 to allow air to flow out through outlet opening 15 together with the liquid.

As shown, the apparatus 1 is supported on surface 3 by the lower end of shaft 8. Additionally or alternatively, depending on the configuration of the impeller and the relative dimensions of outlet 15, the impeller may create a cushion of air within casing assembly 11 which is itself sufficient to support the apparatus on surface 3. Alternatively, the apparatus may be supported on the surface by wheels, for example castors, which may be mounted on casing assembly 11 or, as described hereafter, an additional plate may be provided on which the castors are mounted. The wheels may be freely rotatable, the apparatus being moved by an operator, or may be driven.

As shown in FIG. 3, the apparatus 1 is intended to be moved over the surface 3 by the operator, the apparatus being mounted at the end of a rigid stem 30 through which high pressure liquid is supplied to the apparatus and which is connected by one end to shaft 8 through a flexible hose 31. The other end of stem 30 is connected to a handle 32 incorporating a valve manually operable by a lever 33 for controlling the supply of liquid to the apparatus 1. High pressure liquid for driving the venturi device 24 of the pump is taken from the supply at junction 34 between stem 30 and hose 31 and supplied to device 24 by hose 35. A flexible hose 36 for liquid and air removed from the apparatus 1 is conveniently supported by stem 30.

It will be appreciated that numerous modifications can be made to the above described apparatus for example in the construction of the casing assembly 11 and the manner in which liquid and, in this embodiment ambient fluid, is withdrawn from chamber 12. For example, by using a different method of mounting the impeller blades 11, inner casing 13 may be omitted. Additionally casing 16 may be provided as a single walled casing which supports the sealing means 18 and defines the collection region 19, other means being provided for removing liquid and ambient fluid from region 19.

Figure 4:
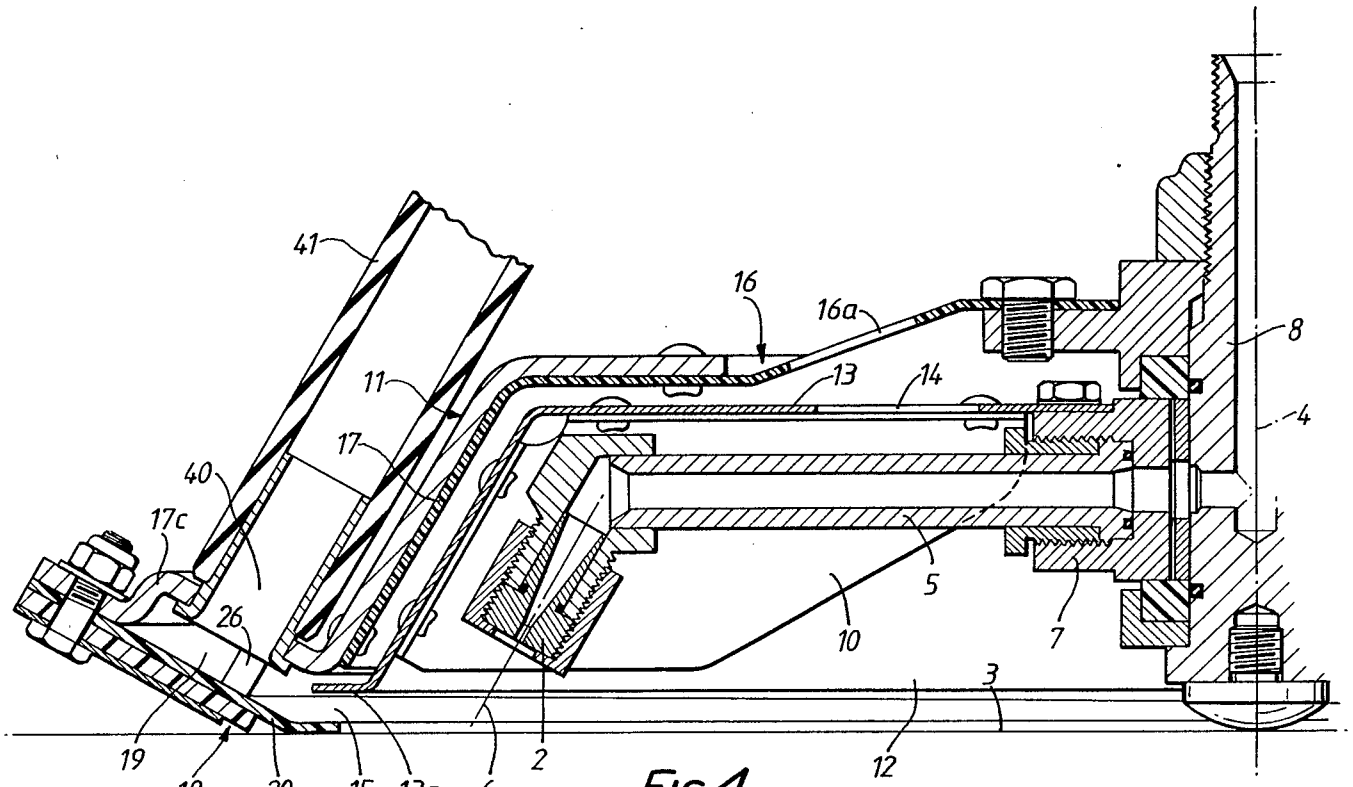
FIGS. 4 and 5 are views similar to those of FIGS. 1 and 2 of another embodiment of apparatus according to the present invention.
Figure 5:
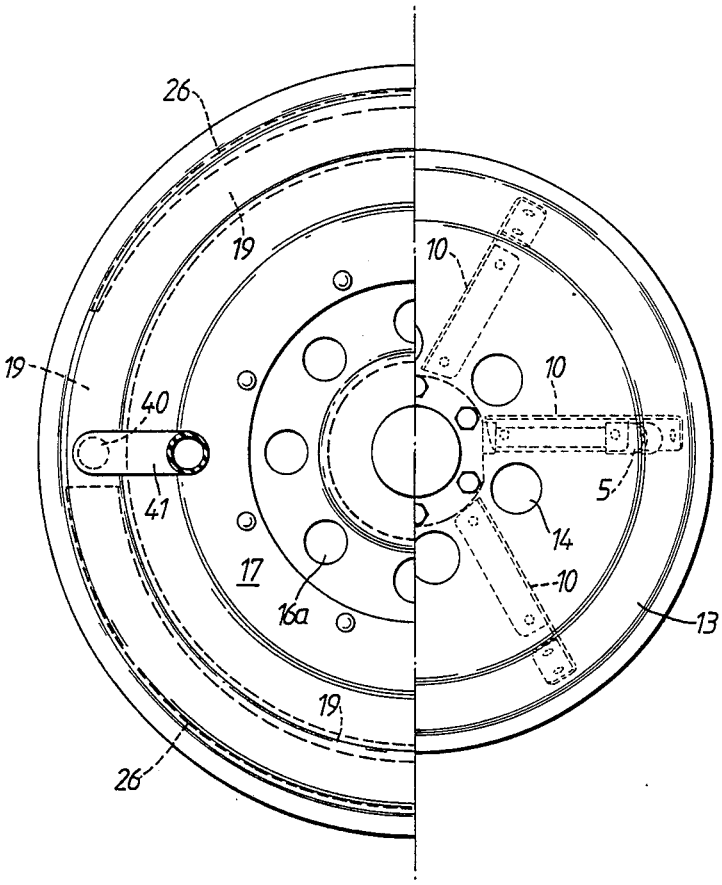

A further embodiment of apparatus in part modified as described above is shown in FIGS. 4, 5 and 6. In these figures, the same reference numerals as are used in the embodiment of FIGS. 1 to 3 are used in this embodiment for like parts.

As in the above described embodiment, the apparatus 1 comprises a plurality of, for example two, nozzle means comprising nozzles 2 and optionally auxiliary nozzles 9, provided at the ends of rotatably mounted arms 5 and, as in the previous embodiment, associated with impeller blades 10, the blades 10 being mounted on an inner casing 13 rotatable with the blades and arms on shaft 8 through which high pressure liquid is supplied to the nozzles 2 and auxiliary nozzles 9 (if provided). The casing assembly 11 comprising inner casing 13, also comprises an outer casing 16 which carries the sealing means 18, similar to the sealing means of the embodiment of FIGS. 1 to 3. As in the previous embodiment, the sealing means 18 defines with an out-turned lip 13*a* on the lower end of casing 13 an annular outlet opening 15 for liquid and fluid from chamber 12. In this embodiment, outer casing 16 comprises a single wall 17 which generally follows the contours of inner casing 13 and co-operates with the outturned lip 13*a* to substantially close the space therebetween. Wall 17 also has an outwardly extending annular flange 17*c* on which the sealing means 18 is mounted but in this embodiment the flange 17*c* has a greater radial extent and defines with the sealing means 18 the liquid collection region 19. The liquid collection region 19 may have an extent radially which varies in the circumferential direction to provide one or more preferential liquid collection zones in which the liquid preferentially collects and into which outlet means for removing liquid (and fluid) therefrom opens. In this embodiment and as most clearly shown in FIG. 5, the liquid collection region 19 has a convolute configuration and the radially outer periphery of the region 19 is defined, as shown, by an insert 26 which may alternatively be formed as part of the sealing means 18 or flange 17*c*. Alternatively, the sealing means 18 may itself be mounted on flange 17*c* to provide the convolute configuration.

Figure 6:
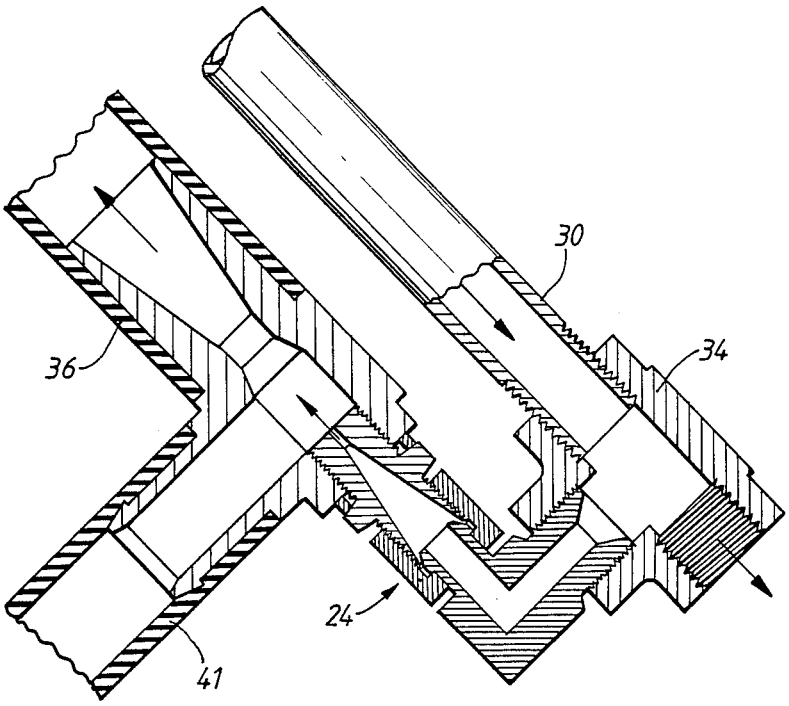
FIG. 6 is a section through a component connected to the apparatus of FIGS. 4 and 5.

Thus, in this embodiment, the liquid collection region 19 has a single radially widest zone which is immediately upstream (in terms of the direction of flow of liquid in region 19) of the radially widest part of the insert 26 and the apparatus has a single outlet 14 which opens into this zone. As in the previous embodiment, a venturi type pump means 24 is provided for removing liquid from region 19 and, as shown, the inlet of the pump means 24 is connected by a flexible hose 41 to outlet 40. For convenience, the pump device 24 is, as shown in FIG. 6, mounted on connection 34 (FIG. 3) and its outlet is connected to flexible hose 36.

It will be appreciated that the above described configuration of the liquid collection region 19 takes advantage of the spiral flow of liquid from nozzles 2 to enable a single outlet to be provided. The apparatus otherwise operates in exactly the same way as the apparatus of FIGS. 1 to 3 and it too may be supported on surface 3 by the lower end of the shaft, by an air cushion generated by the impeller means or by wheels, as described in relation to the embodiment of FIGS. 1 to 3.

In the above described cleaning apparatus, the centrifugal impeller is provided to assist removal of liquid from chamber 12. It has however been found that under some circumstances, e.g. with smaller cleaning apparatus, adequate liquid removal can be achieved without the assistance of the impeller means. The omission of the impeller means, i.e. the impeller blades 10 and the inner casing 13, reduces the mass of the rotatable parts of the apparatus and this can lead to more efficient use of the energy provided by the high pressure cleaning liquid supply.

An embodiment of apparatus without the impeller means is shown in FIGS. 7 to 10 and in this embodiment the same reference numbers are used as are used in the preceding embodiments for like parts. In this embodiment, the arrangement of the nozzle means comprising nozzles 2 and optionally auxiliary nozzles 9, and their mounting on arms 5 extending from hub 7 rotatably mounted on shaft 8 and the supply of liquid to the nozzles through shaft 8, is as described above in relation to the preceding embodiments. In this embodiment, with the inner casing 13 omitted, the construction of the casing assembly 11 has been simplified as has the arrangement for liquid collection and removal from chamber 12 within casing assembly 11.

Figure 7:
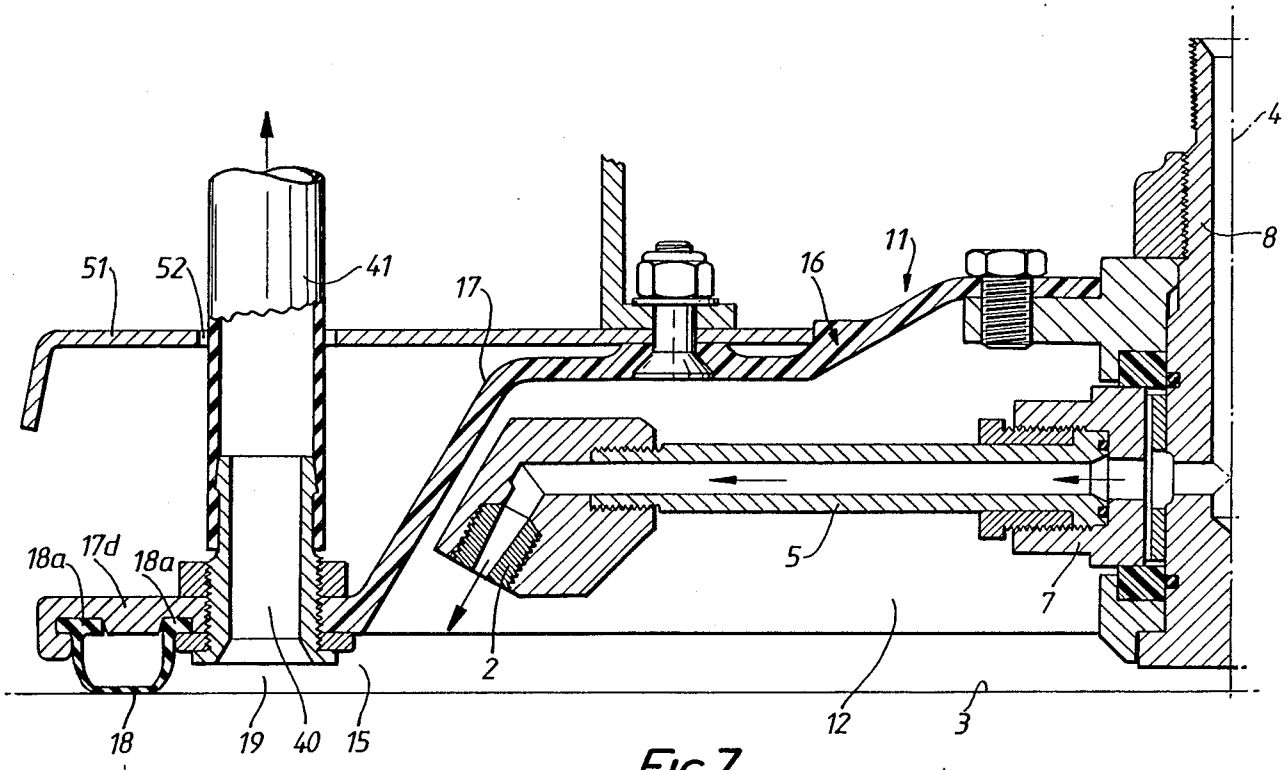
FIG. 7 is an axial section through a further embodiment of apparatus according to the present invention.
Figure 8:
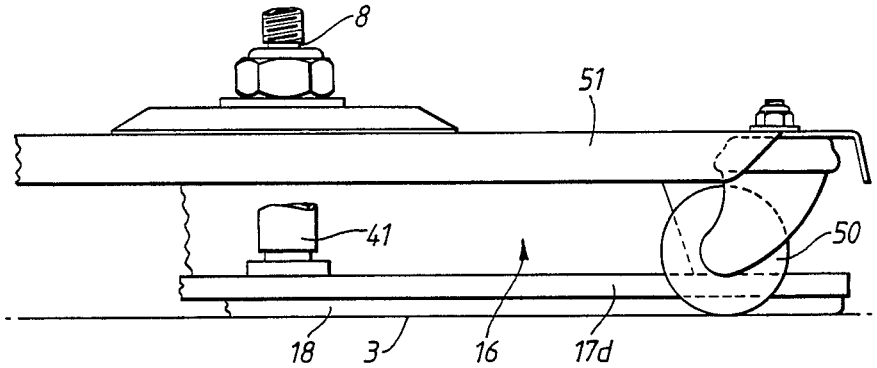
FIGS. 8 and 9 are a partial plan view and side view of the apparatus of FIG. 7.

As shown in FIGS. 7 and 8, casing assembly 11 comprises a single casing 16 with a single wall 17 which has a main part defining chamber 12 surrounding arms 5 and nozzles 2 and an open lower end which is closed by the surface 3 to be cleaned. Around the open lower end, casing 16 is provided with a continuous outwardly extending flange 17*d* which carries sealing means 18. Flange 17*d* and sealing means 18 could in this embodiment be as shown in relation to the embodiment of FIG. 4. However as shown in FIGS. 7 and 8, flange 16*a* extends generally radially of the axis 4, rather than being inclined to the axis as in the embodiment of FIG. 4, and the sealing means is designed to be locally compressible and deflectable to accommodate local protuberances or unevennesses in the surface 3 as the apparatus is moved over the surface 3. As shown, the sealing means 18 is part circular in section and hollow and is formed with retaining flanges 18*a* by which it is retained in flange 17*d*. The seal is made of any suitable flexible material to enable it to deflect locally radially of axis 4 and compress locally axially of axis 4.

In this embodiment, flange 17*d* defines with surface 3 and sealing means 18 an annular liquid collection region 19 connected to chamber 12 by an annular outlet opening 15 defined between the radially inner edge of flange 17*d* and surface 3.

Liquid is withdrawn from liquid collection region 19 through outlet means opening into region 19 through the flange 17*d*. At least one and preferably two, diametrically opposite, outlets 40 are provided and these outlets are, as in the preceding embodiments, connected by flexible hoses 41 to inlets of pump means. Preferably, as in the preceding embodiments, the pump means is energized by high pressure liquid from the supply to the nozzles and, as shown in FIG. 10, may include a venturi device 24 which, for this embodiment, has two inlets for connection to the two outlets 40.

In this embodiment, the liquid collection region 19 has a constant extent radially of axis 4. However, the radial extent of region 19 may vary circumferentially as described in relation to the embodiment of FIG. 4 and this variation may be achieved either by varying the position of sealing means 18 on flange 17*d* or by mounting the sealing means adjacent the outer edge of flange 17*d* and varying the radial extent of the flange. Equally, it will be appreciated that the sealing means 18 of this embodiment may be used in the preceding embodiments in place of the form of sealing means used in these preceding embodiments.

Figure 10:
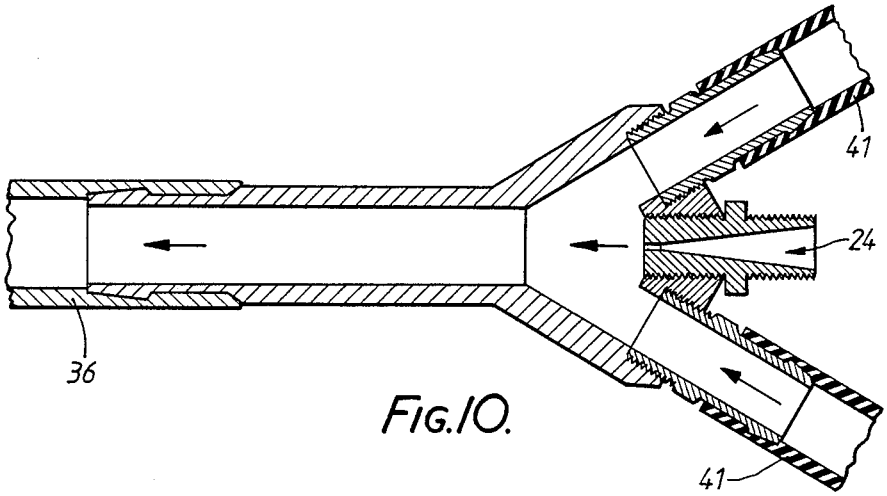
FIG. 10 is a section through a component connected to the apparatus of FIG. 7.
Figure 9:
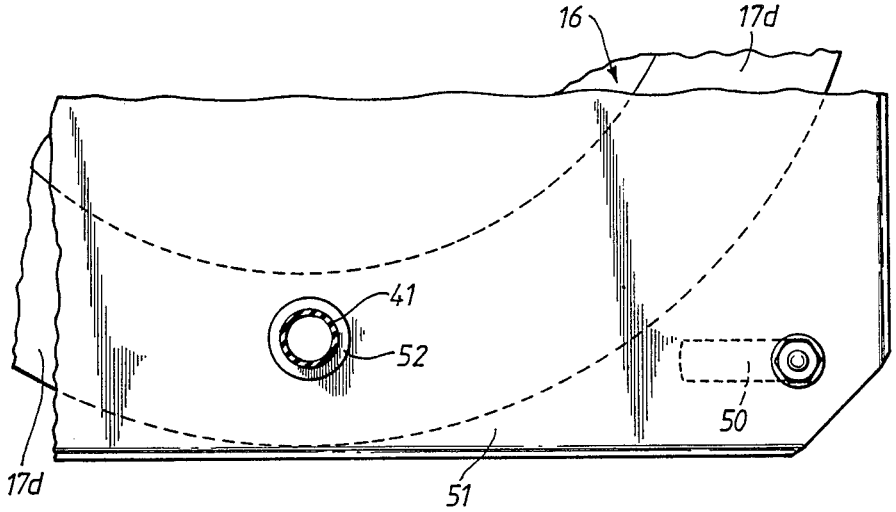

The apparatus shown in FIGS. 8 to 10 is mounted on wheels, e.g. castors 15, which support it on the surface 3. For this purpose, the apparatus may be provided with a mounting plate 51 which is fixed to casing 16. Plate 51 is, in this embodiment, generally square in plan, the sides of the square corresponding to the maximum diameter of casing 16, the castors 15 being mounted one at each of the four corners, as shown more clearly in FIGS. 8 and 9. The plate 51 is apertured, e.g. at 52, to enable the flexible hoses 41 connected to outlets 40 to pass therethrough. The apparatus of this embodiment may be moved using a handle arrangement similar to that shown in FIG. 3 but, as with the embodiment of FIG. 4, the pump means is preferably mounted on connection 34 (FIG. 3).

In the embodiment of FIGS. 7 to 9, because no flow of ambient fluid, e.g. air, is induced through the chamber 12, the apparatus may be supported on the ground with the lower surface of flange 17*d* located just below the anticipated level of cleaning liquid on surface 3 to maximize the effect of the pump means.

It will be appreciated that, although the preferred cleaning liquid for the above described apparatus is water, other liquids may be used. Equally, while the apparatus may operate in air, it can equally operate in other media, for example underwater, where there is a need to remove the cleaning liquid and/or detritus resulting from the cleaning operation.

In preferred embodiments of the above described apparatus, the arms 5, impeller blades 10 (where provided) and inner casing 13 (where provided) are made of stainless steel, the nozzles 2 and 9 (where provided), are made of appropriate wear resistant materials, and the outer casing 16 is molded of a suitable plastics material. The liquid supplied to the apparatus may be at a pressure of the order of 207 to 345 bar (3000 to 5000 psi), at a rate of 0.45 to 0.75 liters per second (6 to 10 gallons per minute) and may cause rotation of the arms 5 and impeller blades 10 at a rate of 1500 to 2000 revolutions per minute.

What is claimed is:

1. Cleaning apparatus for producing a jet of cleaning liquid which is directed against a surface to be cleaned and which rotates about an axis generally perpendicular to the surface to be cleaned, the apparatus comprising nozzle means, means for connecting the nozzle means to a supply of pressurized liquid, means mounting the nozzle means for rotation about said axis, said nozzle means being adapted to provide a jet of cleaning liquid and to cause rotation of the nozzle means about said axis, casing means having an open end for application against the surface to be cleaned, said casing means comprising a main portion and a peripheral portion, said main portion including means delimiting upwardly and laterally to define with the surface a chamber generally coaxial with said axis and surrounding said nozzle means and having a lower edge spaced from the surface said peripheral portion extending laterally from said main portion in the region of said lower edge thereof and including means for upwardly delimiting the height of a liquid collection region extending peripherally around said chamber in the region of said open end thereof, sealing means mounted on said peripheral portion for sealing against the surface to be cleaned and laterally outwardly delimiting said liquid collection region, said upwardly delimiting means of said liquid collection region reducing its height relative to the height of said chamber, said liquid collection region being in unrestricted communication with said chamber over substantially the full extent of said spacing of said lower edge of said main portion of the casing means from the surface for flow of liquid into said liquid collection region from said chamber, and outlet means opening through said peripheral portion into said liquid collection region for the removal therefrom of cleaning 2. Apparatus as claimed in claim 1, the apparatus including impeller means mounted for rotation with the nozzle means within the casing means, the casing means having inlet means for ambient fluid for permitting ambient fluid to enter the chamber in the region of the axis and the outlet means being adapted to permit flow therethrough of cleaning liquid and ambient fluid from the casing means, the arrangement being such that, in use, rotation of the impeller means with the nozzle means about the axis draws ambient fluid into the chamber through the inlet means, flow of ambient fluid from the chamber through the outlet means assisting flow of liquid from the chamber through the outlet means.

3. Apparatus as claimed in claim 2, wherein the impeller means is operable to increase the pressure in the chamber relative to ambient pressure to an extent sufficient to support the apparatus on the surface to be cleaned.

4. Apparatus as claimed in claim 1, wherein the nozzle means is adapted to provide a jet of cleaning liquid directed against the surface to be cleaned and having an axis inclined to the axis of rotation of the nozzle means in a direction such that the jet will be directed away from the axis of rotation of the nozzle means.

5. Apparatus as claimed in claim 1, wherein the nozzle means comprises a first nozzle for providing a jet of cleaning liquid directed against the surface to be cleaned and an auxiliary nozzle associated with the first nozzle and providing a jet of liquid having a substantial component tangential to the path of rotation of the first nozzle to cause rotation of the first nozzle about the axis.

6. Apparatus as claimed in claim 1, wherein the nozzle means comprises a nozzle adapted to provide a jet of cleaning liquid directed against the surface to be cleaned and which has a component directed tangentially of the path of rotation of the nozzle means to cause rotation of the nozzle means about the axis.

7. Apparatus as claimed in claim 1, wherein said outlet means comprises a plurality of outlets equiangularly spaced around the open end of the casing means.

8. Apparatus as claimed in claim 1, including pump means for withdrawing liquid from the chamber through the outlet means.

9. Apparatus as claimed in claim 8, wherein the pump means is adapted and connected to be powered by liquid from the liquid supply for the nozzle means.

10. Apparatus as claimed in claim 1, wherein the liquid collection region has an extent radially of the axis which varies in the circumferential direction and the or each outlet means opens into the widest or each wider zone of the liquid collection region.

11. Apparatus as claimed in claim 10, wherein the liquid collection region has a convolute configuration, the outlet means opening into the radially widest zone of the liquid collection region.

12. Apparatus as claimed in claim 1, including means arranged to support said apparatus on a surface so that said outlet opening has an axial extent slightly less than the anticipated level of liquid collecting in the chamber.

13. Apparatus as claimed in claim 1, including means arranged to support said apparatus on a surface so as to provide the outlet opening with an axial extent slightly greater than the anticipated level of liquid collecting in the chamber to permit ambient fluid to flow through said outlet opening from the chamber.

14. Apparatus as claimed in claim 1, wherein said nozzle means comprises a plurality of nozzles equiangularly spaced about said axis of rotation.

15. Apparatus as claimed in claim 1, wherein said nozzle means is mounted on the end of arm means through which liquid is supplied to said nozzle means.

16. Apparatus as claimed in claim 1, including wheels for supporting the casing on the surface to be cleaned.

* * * * *